US006352449B1

(12) United States Patent
Yasuda et al.

(10) Patent No.: US 6,352,449 B1
(45) **Date of Patent: *Mar. 5, 2002**

(54) LOW PROFILE ELECTRICAL CONNECTOR WITH RESILIENT LATCHING MEANS

(75) Inventors: Noboru Yasuda, Tokyo; Noriaki Sai, Kanagawa, both of (JP)

(73) Assignee: The Whitaker Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/425,669

(22) Filed: Oct. 22, 1999

(30) Foreign Application Priority Data

Oct. 28, 1998 (JP) ..... 10-306512

(51) Int. Cl.[7] ..... H01R 13/40

(52) U.S. Cl. ..... 439/595; 439/205; 439/352; 439/358; 439/679

(58) Field of Search ..... 439/595, 205, 439/679, 352, 353, 358, 357, 596

(56) References Cited

U.S. PATENT DOCUMENTS 4,679,874 A * 7/1987 Saijo et al. ..... 439/595
5,035,654 A * 7/1991 Endo ..... 439/679
5,122,080 A * 6/1992 Hatagishi et al. ..... 439/595
5,859,534 A * 1/1999 Saijo et al. ..... 324/538
5,984,736 A * 11/1999 Sakurai et al. ..... 439/748

OTHER PUBLICATIONS

Japanese Utility Model No. 60–123883, Aug. 1985.

* cited by examiner

*Primary Examiner*—Tho D. Ta
*Assistant Examiner*—Truc Nguyen

(57) ABSTRACT

The present invention provides a relatively compact electrical connector which is equipped with a resilient latching mechanism (21) on one side of a housing (20), and which accommodates a plurality of different types of electrical contacts inside the housing. The housing (20) of the electrical connector (10) has relatively-small first cavities (30*a*) which accommodate electrical contacts (60) that have contact lances (61), and relatively-large second cavities (30*b*) which have housing lances (57) used to latch electrical contacts (70). Mold-release apertures (54) used to form the housing lances (57) are located inside rigid walls (81) that protect the resilient latching arm (21) from both sides and mold-release apertures (44) used to form latching shoulders (43) are located in another side of the housing opposite the one side of the housing.

8 Claims, 3 Drawing Sheets

Fig. 2a
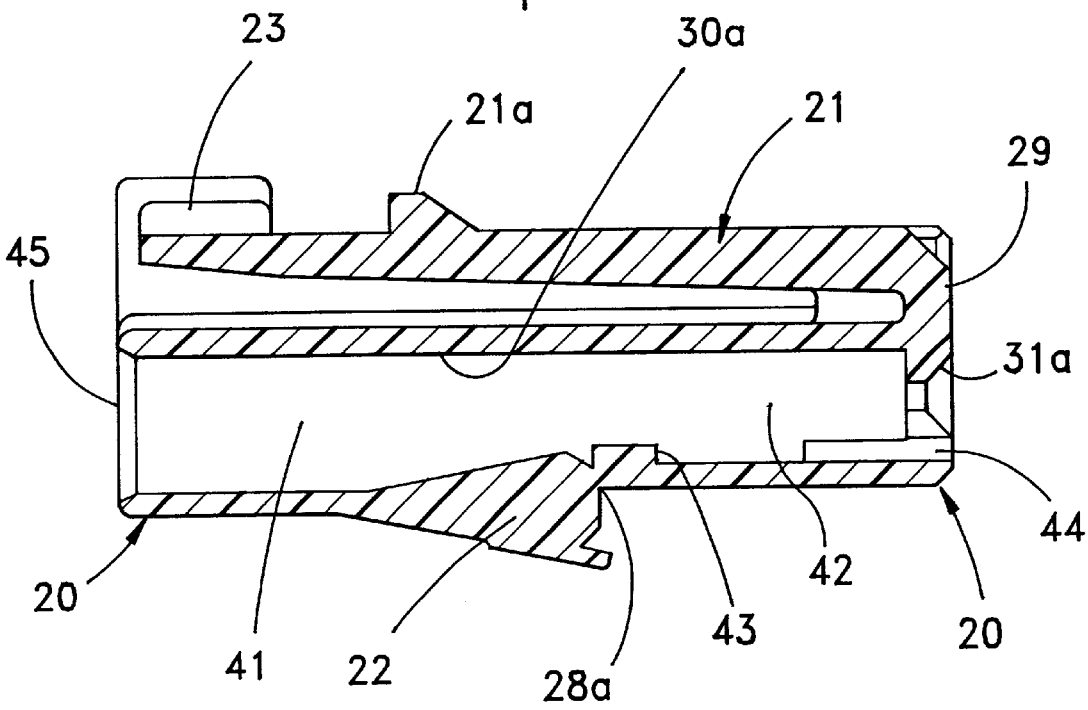
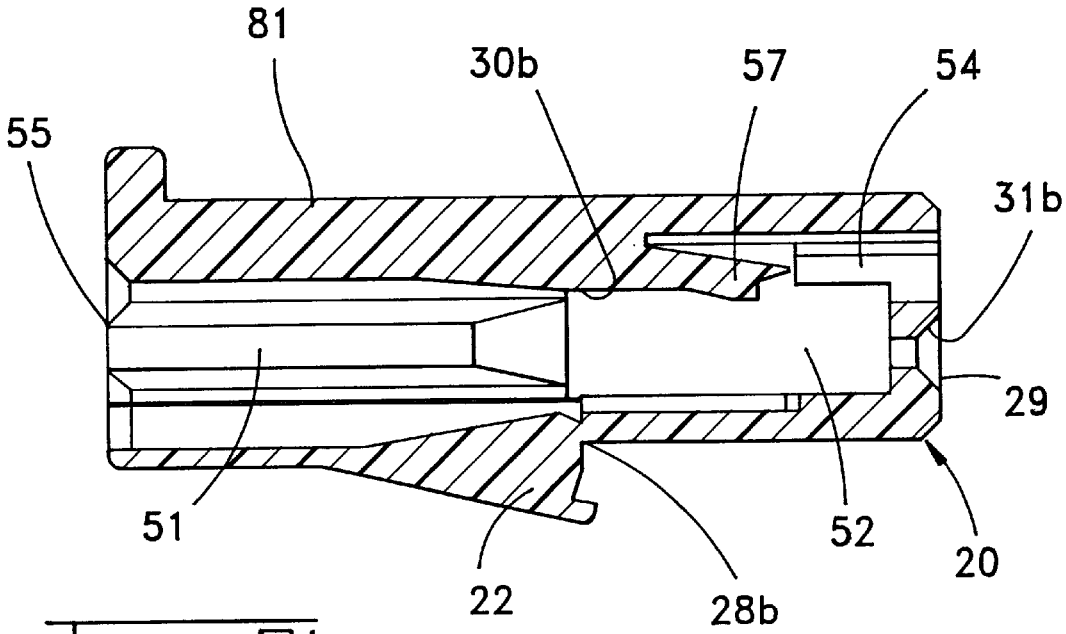
Fig. 2b

LOW PROFILE ELECTRICAL CONNECTOR WITH RESILIENT LATCHING MEANS

FIELD OF THE INVENTION

The present invention relates to an electrical connector, and more specifically it relates to an electrical connector which has a resilient latching means extending along one side or surface of a housing.

BACKGROUND OF THE INVENTION

An example of an electrical connector of this type is disclosed in Japanese Utility Model No. 60-123883 wherein a plug electrical connector has a resilient latching arm, which maintains engagement with a mating connector, is disposed along one side or surface of a housing. Protective walls, which prevent damage to the resilient latching arm, are disposed on both sides thereof.

In recent years, in electrical connectors of this type, there have been simultaneous demands for both the accommodation of electrical contacts of a plurality of different types, and a further reduction in overall size. The object of the present invention is to provide an electrical connector which meets these demands. In more concrete terms, the object of the present invention is to provide a relatively compact electrical connector, which is equipped with a resilient latching arm extending along a side or surface of a housing and which accommodates a plurality of different types of electrical contacts inside the housing.

SUMMARY OF THE INVENTION

The present invention is directed to an electrical connector comprising a dielectric housing having first cavities and second cavities with the second cavities being of larger dimension than the first cavities that respectively accommodate first and second electrical contacts of different shapes and dimensions, and a resilient latching means to maintain engagement with a mating electrical connector is disposed along one side or surface of the housing, a cavity row which includes both the first cavities and the second cavities is located along the surface along which the resilient latching means is located, the first cavities are disposed in positions that overlap with the resilient latching means, and at least some of the first cavities are disposed so that they are positioned inside protective walls that are located on both sides of the resilient latching means for the purpose of protecting the resilient latching means.

The first electrical contacts have contact lances that are latched inside the first cavities, and the second cavities have housing lances that latch the second electrical contacts therein.

The openings of the first and second cavities are lined up in a single row.

First mold-release openings used to mold shoulders that engage with the contact lances corresponding to the first cavities are located in the side of the housing that is separated from the resilient latching means.

Second mold-release openings used to mold the housing lances corresponding to the second cavities are positioned inside the protective walls.

An electrical connector comprising a dielectric housing having first cavities and second cavities with the first cavities being smaller than the second cavities, first electrical contacts disposed in the first cavities and second electrical contacts disposed in the second cavities, a resilient latching member on the dielectric housing extending along one side thereof, wherein the first and second cavities extend in a row along the one side of the dielectric housing, protective walls are provided on the one side of the dielectric housing on opposing sides of the resilient latching member, some of the first cavities overlap with the resilient latching member, and the second cavities are located in the protective walls.

BRIEF DESCRIPTION OF THE DRAWINGS

An embodiment of the present invention will now be described by way of example with reference to the accompanying drawings in which:

FIG. 1*a* is a plan view, FIG. 1*b* is a front view, and FIG. 1*c* is a side view.

FIGS. 2*a* and 2*b* show cross-sectional views of the housing shown in FIG. 1; FIG. 2*a* is a cross-sectional view taken along line 2*a*—2*a* in FIG. 1*b,* and FIG. 2*b* is a cross-sectional view taken along line 2*b*—2*b* in FIG. 1*b.*

FIG. 3*a* is a plan view, and FIG. 3*b* is a side view.

FIG. 4*a* is a plan view, and FIG. 4*b* is a side view.

DETAILED DESCRIPTION OF THE INVENTION

Figure 1A:
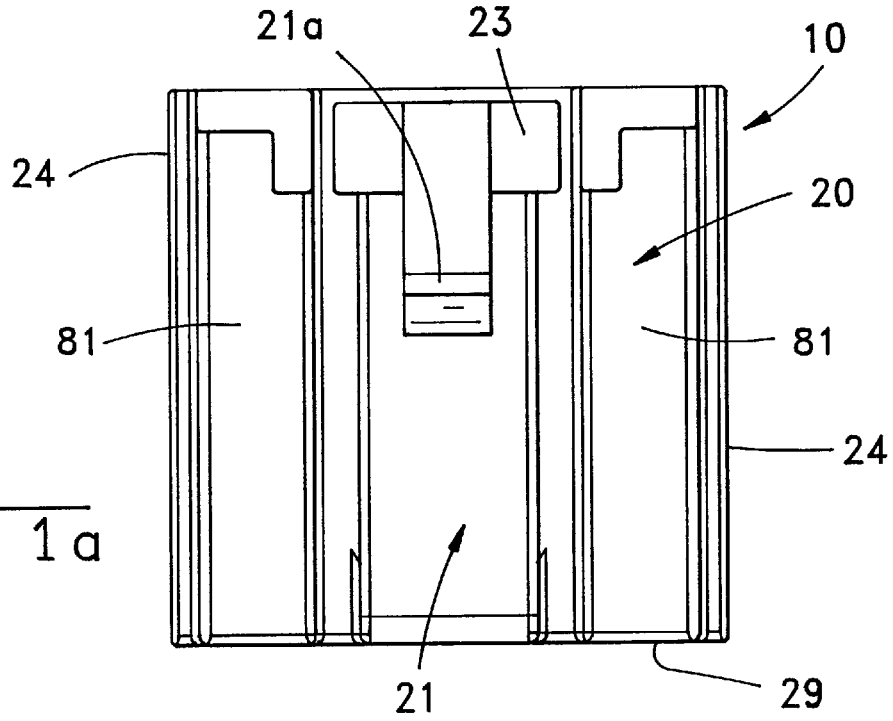
FIGS. 1*a*—1*c* show an electrical connector of the present invention.
Figure 1B:
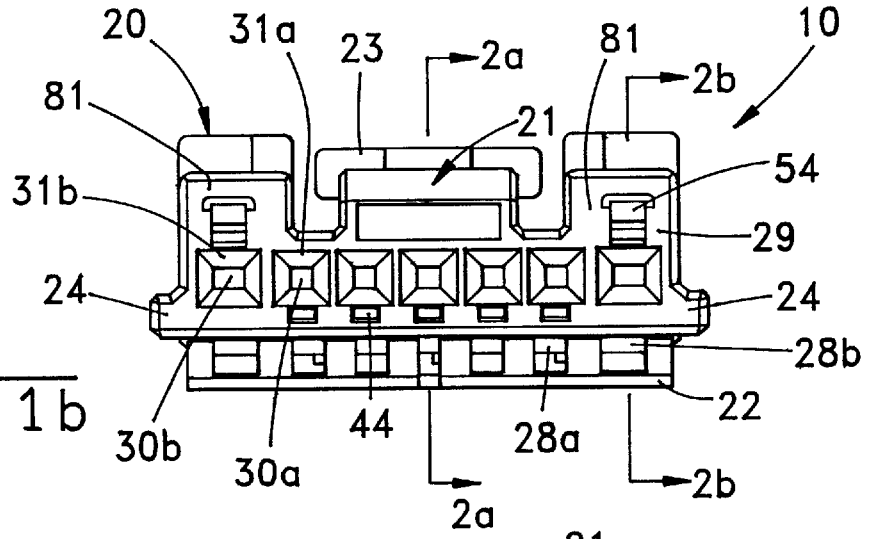
Figure 1C:
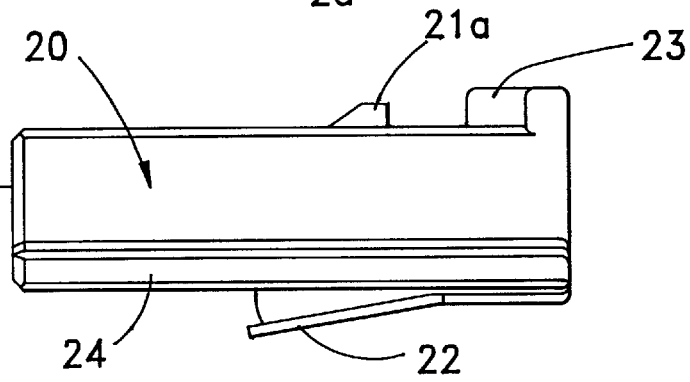

In FIG. 1, electrical connector 10 of the present invention has a dielectric housing 20 which is equipped with cavities 30*a,* 30*b* to accommodate a plurality of electrical contacts. The housing 20 is molded from a suitable resin, and it has an integral resilient latching arm or resilient latching means 21 to maintain latching engagement with a mating electrical connector (not shown) on one side, i.e., an upper side or surface. The resilient latching arm 21 has the form of a cantilever member, which extends rearward from a mating surface 29, and a latching projection 21*a.* An operating section 23, which is used to operate the latching arm 21 in order to release the latching engagement with the mating connector, is located near a free end of the latching arm 21. A double-latching member 22, which is disposed so that it can pivot by means of an integral hinge, is located on an opposite side from the side on which the latching arm 21 is positioned. In FIG. 1, the double-latching member 22 is shown in an open position; however, after electrical contacts have been fully inserted into prescribed cavities 30*a,* 30*b* of the housing 20, the double-latching member 22 is pushed into the housing 20 and prevents the contacts from slipping out of the cavities. Ribs 24, which extend in the direction of engagement are located on both sides of the housing 20. The ribs 24 are located in positions that are shifted from the center of the housing 20 with respect to the direction of height, and they act to prevent backward engagement when the electrical connector is engaged with the mating connector.

As is especially clear from FIG. 1*b,* the cavities 30*a,* 30*b* in the housing 20 are disposed so that openings 31*a,* 31*b* to accommodate mating male electrical contacts form a single row. The five small cavities 30*a* positioned on each side of the center accommodate relatively small electrical contacts 60 shown in FIGS. 3*a,* 3*b,* while the two large cavities 30*b* positioned at both ends of the row accommodate the relatively-large electrical contacts 70 shown in FIGS. 4*a,* 4*b.*

Figure 3A:
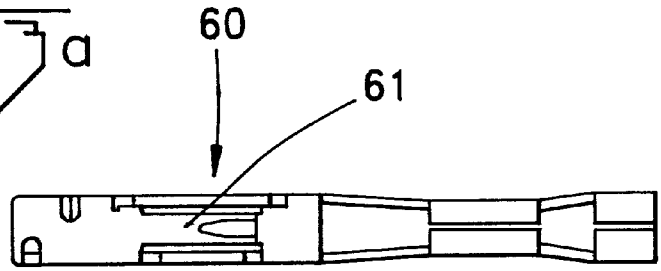
FIGS. 3*a* and 3*b* show a first electrical contact accommodated in first cavities of the housing.
Figure 3B:
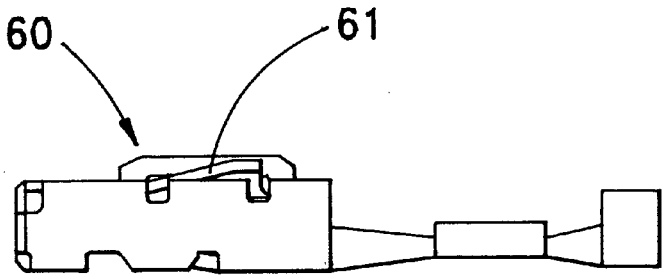
Figure 4A:
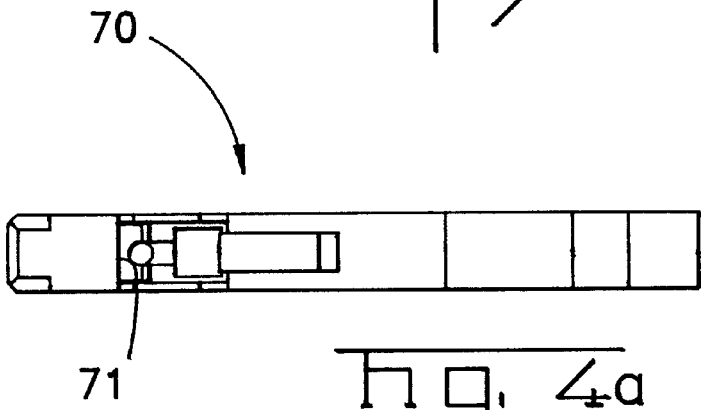
FIGS. 4*a* and 4*b* show a second electrical contact accommodated in second cavities of the housing.
Figure 4B:
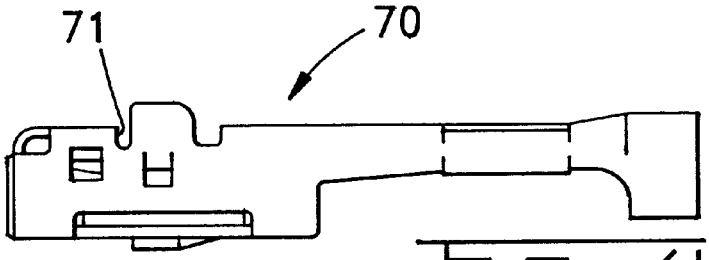

A cross-section of one of the cavities 30*a* is shown in FIG. 2*a.* Each of the cavities 30*a* has rear section 41, which has a relatively-large space, and a front section 42, which has a relatively-small space. The corresponding electrical contact 60 is inserted into cavity 30*a* via insertion opening 45 at the rear section 41 and is accommodated inside the cavity 30*a*. As shown in FIGS. 3*a,* 3*b,* electrical contact 60 has a contact lance 61, and it can be held inside the cavity 30*a* by means of lance 61. The cavity 30*a* has a latching shoulder 43, which is engaged by a free end of the contact lance 61. For each cavity 30*a,* a mold-release aperture 44, which is used to remove a pin that forms latching shoulder 43, is located so that mold-release apertures 44 open at front surface 29 of housing 20. As shown in FIG. 1*b* or FIG. 2*a,* the mold-release apertures 44 are positioned adjacent a bottom side of each opening 31*a*. It should be noted that a base portion of the double-latching member 22 is endowed with sufficient mechanical strength by locating the mold-release apertures 44 on the opposite side of the housing 20 from the double-latching member 22. The fully-inserted contacts 60 are securely held by engaging shoulders 28*a* of the double-latching member 22 when the double-latching member 22 is inserted into the cavities 30*a*.

A cross section of one of the cavities 30*b* is shown in FIG. 2*b*. Each of the cavities 30*b* also has a rear section 51, which has a relatively-large space, and a front section 52, which has a relatively-small space. Electrical contact 70 shown in FIGS. 4*a,* 4*b* is inserted via insertion opening 55 of the rear section 51, and it is accommodated inside the cavity 30*b*. A housing lance 57, which latches the electrical contact 70 in cavity 30*b,* is located inside each cavity 30*b*. When the electrical contact 70 is fully inserted into the cavity 30*b,* a latching surface 71 on the contact 70 engages with the housing lance 57, so that the contact 70 is latched inside the cavity 30*b*. For each cavity 30*b,* a mold-release aperture 54, which is used to remove a pin that forms the housing lance 57, is located so that mold-release aperture 54 opens at the front surface 29. As shown in FIG. 1*b* or FIG. 2*a,* the mold-release apertures 54 are located adjacent an upper side of each opening 31*b*. Furthermore, the fully-inserted electrical contacts 70 are securely held in the cavities 30*b* by the engaging shoulders 28*b* of the double-latching member 22 in the same manner that the electrical contacts 60 are held in the cavities 30*a*.

An important feature in the present invention is that the mold-release apertures 54 used to form the housing lances 57 are formed inside rigid walls 81, which are located on both sides of the housing 20. The rigid walls 81 are constituent members that are located on both sides of the resilient latching arm 21 at a height position which is such that the rigid walls 81 overlap with the latching arm 21; the rigid walls 81 act to protect the resilient latching arm 21 and are therefore protective walls 81. Thus, the cavities 30*b,* which require a relatively large space in order to allow the formation of the housing lances 57, are installed in positions separated from the resilient latching arm 21 inside the protective walls 81 formed for the purpose of protecting the resilient latching arm 21, while the relatively small cavities 30*a* in which the contacts 60 are engaged by means of their own contact lances 61 are disposed in positions being overlapped by the resilient latching arm 21; as a result, the height dimension of the electrical connector 10 can be minimized.

An electrical connector constituting a preferred embodiment of the present invention has been described above; however, this embodiment is merely an example, and does not limit the present invention; various modifications and alterations may be made by a person skilled in the art. For example, in the present invention, the cavities 30*b* in which the housing lances 57 are located are shown as relatively large cavities, and the cavities 30*a,* which are constructed so that the electrical contacts 60 are latched therein by means of the contact lances 61, are shown as relatively small cavities; however, the cavity size may also be set so that it depends on the simple contact dimensions. Furthermore, in the present embodiment, the central positions of the openings 31*a,* 31*b* are shown as coinciding completely; however, this depends on requirements arising from the double-latching member 22 and the dimensions of the mating connector and other factors; thus, the present invention is not necessarily limited to such a construction.

The electrical connector of the present invention has the following construction: specifically, a cavity row which includes both first and second cavities of different sizes is formed along one side of a housing on which a resilient latching means is located. Relatively small first cavities are disposed in positions that overlap with the resilient latching means, while at least some of the relatively large second cavities are formed on both sides of the resilient latching means so that these cavities are positioned inside protective walls formed for the purpose of protecting the resilient latching means. Accordingly, an electrical connector, which has a resilient latching arm or resilient latching means on one side of the housing, and which accommodates a plurality of different types of electrical contacts inside the housing, can be provided with an extremely-small dimension in the direction of height.

What is claimed is:

1. An electrical connector comprising:

a dielectric housing comprising a substantially box shaped member with upper, lower, side, face, and end surfaces;

a plurality of first and second cavities oriented longitudinally in said housing, each cavity having respective openings in the front and rear faces of the housing;

the first cavities being of smaller size relative to the second cavities, said plurality of cavities being horizontally aligned along the face of the housing to form a single row of cavities;

the upper surface of the housing having sections of increased height disposed on opposite longitudinal edges of the upper surface, thereby forming a channel between said sections;

a resilient latching means attached to the upper surface of the housing adjacent the front surface and disposed within said channel;

said first cavities being disposed substantially below said channel and said second cavities being disposed below said heightened sections;

said first cavities having a latching shoulder adapted to engage a latching lance on electrical contacts positioned within the first cavities, the latch and shoulder comprising means for retaining the connector in the cavity; and said second cavities having a latching lance adapted to engage a shoulder on electrical contacts positioned within the second cavities, the latch and shoulder comprising means for retaining the connector in the cavity.

2. The connector of claim 1 further comprising an alignment rib disposed longitudinally along each respective side surface of the housing.

3. The electrical connector of claim 1, further comprising a secondary locking member disposed on the lower surface of the housing, said secondary locking member being adapted for engagement with the electrical contacts when the electrical contacts are positioned within the first and second cavities, respectively.

4. The electrical connector of claim 3, wherein said secondary locking member comprises a flap hinged along a rear portion of the lower surface of the housing, said flap extending substantially the width of the housing.

5. The electrical connector of claim 3, wherein said flap is provided with a plurality of latching shoulders, each corresponding to a respective first or second cavity, which latching shoulders are adapted to be received within said respective cavities when the secondary locking member is engaged.

6. The electrical connector of claim 1, further comprising a plurality of mold-release apertures, each aperture corresponding to each of said first and second cavities, respectively.

7. The electrical connector of claim 6, wherein the mold-release apertures corresponding to the first cavities are disposed below the opening of the respective cavity in the front surface of the housing.

8. The electrical connector of claim 7, wherein the mold-release apertures corresponding to the second cavities are disposed above the opening of the respective cavity in the front surface of the housing.

* * * * *